United States Patent [19]

Eida et al.

[11] 4,245,033

[45] Jan. 13, 1981

[54] HEAT DEVELOPABLE PHOTOSENSITIVE COMPOSITION AND A HEAT DEVELOPABLE PHOTOSENSITIVE MEMBER HAVING A LAYER COMPRISING THE COMPOSITION

[75] Inventors: Tsuyoshi Eida, Chiba; Ichiro Endo, Yokohama, both of Japan

[73] Assignee: Canon Kabushiki Kaisha, Tokyo, Japan

[21] Appl. No.: 827,779

[22] Filed: Aug. 25, 1977

Related U.S. Application Data

[63] Continuation of Ser. No. 643,810, Dec. 23, 1975, abandoned.

[30] Foreign Application Priority Data

Dec. 28, 1974 [JP] Japan ..... 49-2516

[51] Int. Cl.[2] ..... G03C 1/02

[52] U.S. Cl. ..... 430/353; 430/611; 430/614; 430/620

[58] Field of Search ..... 96/114.1, 109, 76 R, 96/66 T, 67, 48 HD

[56] References Cited

U.S. PATENT DOCUMENTS

| | | | |
|---|---|---|---|
| 3,094,417 | 6/1963 | Workman | 96/114.1 |
| 3,305,362 | 2/1967 | Riester et al. | 96/109 |
| 3,653,907 | 4/1972 | Benbrook et al. | 96/114.1 |
| 3,785,813 | 1/1974 | Rickter | 96/76 |
| 3,801,321 | 4/1974 | Evans et al. | 96/114.1 |
| 3,819,379 | 6/1974 | Ohyama et al. | 96/109 |

*Primary Examiner*—J. Travis Brown

*Attorney, Agent, or Firm*—Fitzpatrick, Cella, Harper & Scinto

[57] ABSTRACT

A heat developable photosensitive composition comprises an organic silver salt, a halide and a sulfur compound.

27 Claims, No Drawings

HEAT DEVELOPABLE PHOTOSENSITIVE COMPOSITION AND A HEAT DEVELOPABLE PHOTOSENSITIVE MEMBER HAVING A LAYER COMPRISING THE COMPOSITION

This is a continuation application Ser. No. 643,810, filed Dec. 23, 1975, now abandoned.

This application is related to: application Ser. No. 608,006, filed Aug. 26, 1975, now U.S. Pat. No. 4,036,650, issued July 10, 1977 which was copending with parent application Ser. No. 643,810; application Ser. No. 599,061 filed July 25, 1975, now U.S. Pat. No. 4,069,759, issued Jan. 24, 1978 and Ser. No. 685,460, filed May 12, 1976, now U.S. Pat. No. 4,057,016, issued Nov. 8, 1977.

BACKGROUND OF THE INVENTION

1. Field of the Invention

This invention relates to a heat developable photosensitive composition containing an organic silver salt and a heat developable photosensitive member having a layer comprising the composition.

2. Description of the Prior Art

Photosensitive materials for forming silver images have been widely used and can give high quality of images which can be formed at high sensitivity. As the materials for forming silver images, there are usually known materials including organic silver salts as well as conventional silver halide emulsion. The silver image forming heat developable photosensitive materials including organic silver salts can be developed by a heat treatment alone after imagewise exposure. These silver image forming heat developable photosensitive materials can easily form images, in particular, the images can be formed by a dry process, and therefore, these materials have various advantages different from those resulting from conventional silver halide emulsions of a wet developing type and are expected to have wide application fields.

Such heat developable photosensitive material comprising an organic silver salt contains an organic silver salt and a halide as its essential components. The image formation is carried out by imagewise exposure of the heat developable photosensitive material and then heat development. In detail, the imagewise exposure causes a photochemical reaction of the halide with the organic silver salt to isolate a small amount of silver resulting in the formation of a latent image, and the small amount of silver thus isolated can be nucleus for developing the silver isolated from the organic silver salt by the subsequent developing procedure to produce a silver image at the exposed portions and thus complete the formation of a visible image.

These heat developable photosensitive materials comprising an organic silver salt usually do not have a high sensitivity because the materials are not mainly composed of a photosensitive substance of high sensitivity as in case of conventional silver halide emulsions, and further the original photosensitive composition remains at the non-exposed portion without subjecting to any change and therefore, isolation of silver at the non-exposed portion (non-image portion) is observed upon heat development, and it is very difficult to produce images of so high contrast as in case of a silver halide emulsion. In addition, even after the formation of images (silver images), the non-exposed portions have the same composition as that of the original (before exposure) photosensitive composition, and therefore, isolation of silver from the remaining organic silver salt is observed. In fact, fogging phenomenon is observed after the formation of images. Consequently, it is not possible to maintain the image quality (particularly, contrast) obtained upon the image formation, and the image stability is not sufficiently high.

SUMMARY OF THE INVENTION

According to the present invention, there is provided a heat developable photosensitive composition which comprises an organic silver salt, a halide, and at least one member selected from the class of sulfur compounds, and also there is provided a heat developable photosensitive member which comprises a layer containing the above mentioned heat developable photosensitive composition and a reducing agent.

According to the present invention, there is provided a heat developable photosensitive member which comprises a layer containing the above mentioned heat developable photosensitive composition and a layer containing a reducing agent, the latter layer overlying the former layer.

An object of the present invention is to provide a heat developable photosensitive composition comprising mainly an organic silver salt free from the above-mentioned drawbacks.

Another object of the present invention is to provide a heat developable photosensitive composition capable of producing a high image contrast.

A further object of the present invention is to provide a heat developable photosensitive composition in which the isolation of silver from the organic silver salt at the exposed portion is accelerated upon heat developing while the isolation at the non-exposed portion is suppressed.

Still another object of the present invention is to provide a heat developable photosensitive composition in which the isolation of silver from the remaining organic silver salt after the completion of formation of images (after development) is suppressed to maintain the image quality at the time of said formation of images without any change.

Still another object of the present invention is to provide a heat developable photosensitive member of high sensitivity and high resolving power having a layer containing the above mentioned heat developable photosensitve composition.

DESCRIPTION OF THE PREFERRED EMBODIMENTS

The sulfur compounds used in the present invention are compounds having the following formulas (1)-(6):

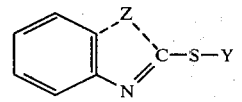

(1)

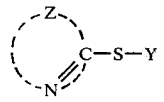

(2)

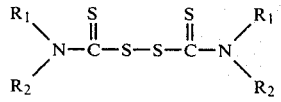

(3)

-continued $$R_3-O-\overset{\overset{\displaystyle S}{\|}}{C}-S-S-\overset{\overset{\displaystyle S}{\|}}{C}-O-R_3 \quad (4)$$

$$R_4-\overset{\overset{\displaystyle O}{\|}}{C}-S-S-\overset{\overset{\displaystyle O}{\|}}{C}-R_4 \quad (5)$$

$$HOOC-R_5-S_x-R_6-COOH \quad (6)$$

In the above formulas, Y is selected from the class of hydrogen, alkyl, unsubstituted or substituted phenyl, aralkyl, and

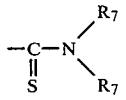

where $R_7$ is selected from alkyl having 1–4 carbon atoms and benzyl. The alkyl is preferably an alkyl having 1–6 carbon atoms.

Z is one or more atoms necessary for forming a 5- or 6- membered heterocyclic ring which may be unsubstituted or substituted, for example, in case of the formula (1), benzthiazole ring, benzoxazole ring and benzimidazole ring, and in the formula (2), thiazoline ring, imidazole ring, imidazoline ring, triazole ring, pyrroline ring, pyridine ring, thiadiazole ring, thiadiazoline ring, pyrazole ring, pyrimidine ring and oxadiazole ring.

$R_1$ and $R_2$ are selected from the class of alkyl, unsubstituted or substituted phenyl and aralkyl. $R_1$ and $R_2$ may be similar or dissimilar, preferably similar. The alkyl is preferably an alkyl having 1–8 carbon atoms and the aralkyl is preferably benzyl.

$R_3$ is selected from the class of alkyl, preferred with an alkyl having 1-8 carbon atoms, and aralkyl, preferred with benzyl.

$R_4$ is selected from the class of alkyl, unsubstituted or substituted phenyl and aralkyl, and it is preferably an alkyl having 1–8 carbon atoms, unsubstituted phenyl, phenyl substituted by nitro, methyl, methoxy, halogen etc., and benzyl.

$R_5$ and $R_6$ are, similar or dissimilar, alkylene, preferably an alkylene having 1–8 carbon atoms.

x is an integer of 1–4.

The addition of a sulfur compound to a heat developable photosensitive composition comprising an organic silver salt as disclosed in the present invention results in production of fogless and high contrast images and high stability. In particular, as is shown in the Examples, the sulfur compounds of formulas (1), (2), (3), (4), (5) and (6) accelerate isolation of silver at exposed portions and suppress isolation of silver at non-exposed portions in the process of forming images, and further suppress spontaneous isolation of silver from the organic silver salt at any portions after formation of images to maintain the original image quality. The sulfur compound according to the present invention has excellent effects and is an additive different from and better than conventional image stabilizers, sensitizers, and image quality controlling agents.

The sulfur compounds of formulas (1), (2), (3), (4), (5) and (6) have the desired effects regardless of types of the organic silver salts.

The amount of the sulfur compound of formula (1), (2), (3), (4), (5), or (6) is usually $10^{-4}$–$10^{-1}$ part by weight per one part by weight of the organic silver salt compound, and preferred with $5\times10^{-4}$–$10^{-2}$ by weight.

Representative sulfur compounds of formulas (1), (2), (3), (4), (5) and (6) are as shown in Tables 1, 2, 3, 4, 5 and 6, respectively.

Table 1

| Sulfur compounds of formula (1) | |
|---|---|
| Compound | |
| 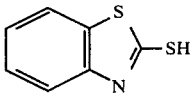 | 2-mercaptobenzothiazole |
| 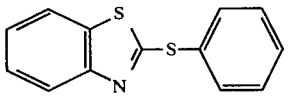 | 2-phenylmercaptobenzothiazole |
| 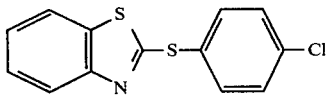 | 2-(p-chlorophenylmercapto) benzothiazole |
| 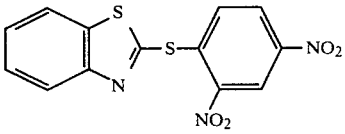 | 2(2,4-dinitrophenylmercapto) benzothiazole |
| 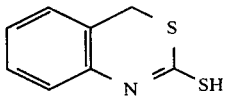 | 2-mercapto-4,5-benzo-1,3-thiazine |

Table 1-continued

| Sulfur compounds of formula (1) Compound | |
|---|---|
| 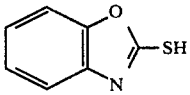 | 2-mercaptobenzoxazole |
| 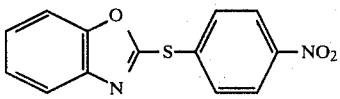 | 2-(p-nitrophenylmercapto) benzoxazole |
| 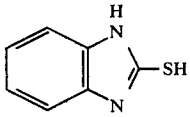 | 2-mercaptobenzimidazole |
| 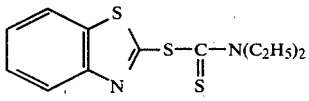 | diethyldithiocarbamic acid 2-benzothiazolyl ester |
| 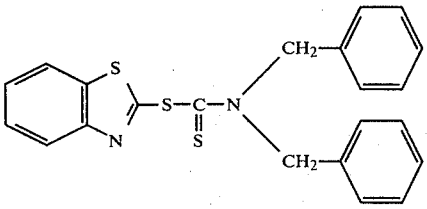 | dibenzyldithiocarbamic acid 2-benzothiazolyl ester |
| 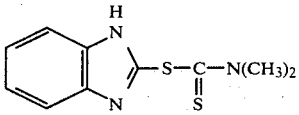 | dimethyldithiocarbamic acid 2-benzimidazolyl ester |
| 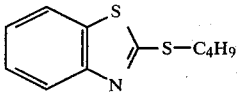 | 2-butylmercaptobenzothiazole |
| 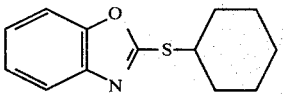 | 2-cyclohexylmercapto-benzoxazole |
| 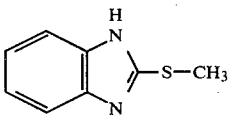 | 2-methylmercaptobenzimidazole |
| 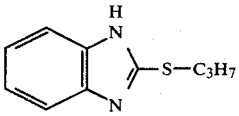 | 2-propylmercaptobenzothiazole |
| 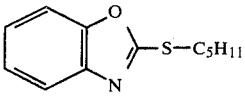 | 2-pentylmercaptobenzoxazole |
| 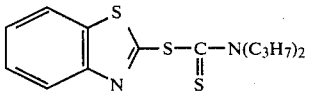 | dipropyldithiocarbamic acid 2-benzothiazolyl ester |

Table 1-continued

| Sulfur compounds of formula (1) Compound | |
|---|---|
| 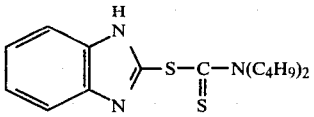 | dibutyldithiocarbamic acid 2-benzimidazolyl ester |
| 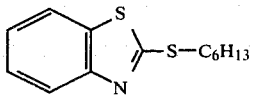 | 2-hexylmercaptobenzothiazole |

Table 2

| Sulfur compounds of formula (2) Compound | |
|---|---|
| 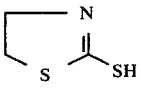 | 2-mercaptothiazoline |
| 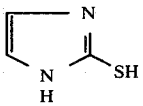 | 2-mercaptoimidazole |
| 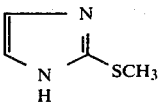 | 2-methylmercaptoimidazole |
| 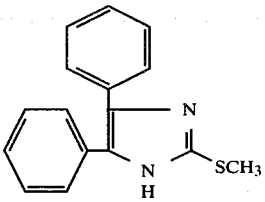 | 2-methylmercapto-4,5-diphenylimidazole |
| 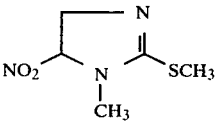 | 1-methyl-5-nitro-2-methylmercaptoimidazole |
| 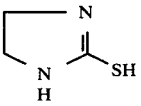 | 2-mercaptoimidazoline |
| 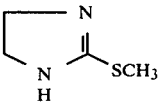 | 2-methylmercaptoimidazoline |
| 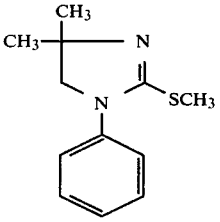 | 1-phenyl-2-methylmercapto-4,4-dimethyl-5-imidazoline |

Table 2-continued

| Sulfur compounds of formula (2) | |
|---|---|
| Compound | |
| 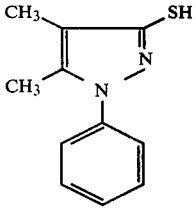 | 1-phenyl-3-mercapto-4,5-dimethylpyrazole |
| 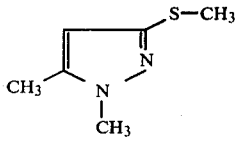 | 3-methylmercapto-1,5-dimethylpyrazole |
| 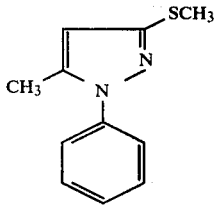 | 1-phenyl-3-methylmercapto-5-methylpyrazole |
| 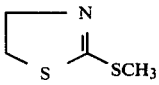 | 2-methylmercaptothiazoline |
| 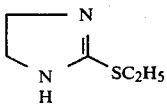 | 2-ethylmercaptothiazole |
| 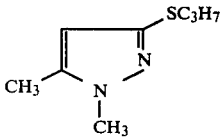 | 3-propylmercapto-1,5-dimethylpyrazole |
| 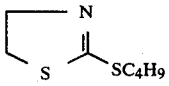 | 2-butylmercaptothiazoline |
| 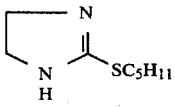 | 2-pentylmercaptoimidazoline |
| 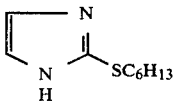 | 2-hexylmercaptoimidazole |
| 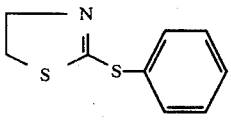 | 2-phenylmercaptothiazoline |
| 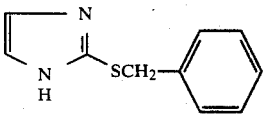 | 2-benzylmercaptoimidazole |

Table 2-continued

| Sulfur compounds of formula (2) Compound | |
|---|---|
| 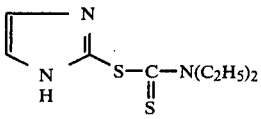 | diethyldithiocarbamic acid 2-imidazolyl ester |
| 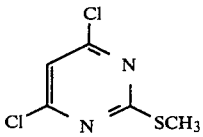 | 4,6-dichloro-2-methylmercaptopyrimidine |
| 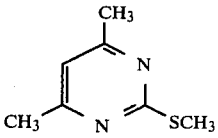 | 2-methylmercapto-4,6-dimethylpyrimidine |
| 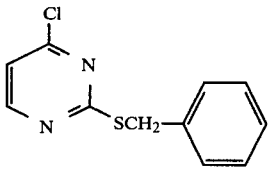 | 4-chloro-2-benzylmercaptopyrimidine |
| 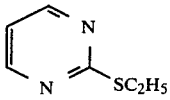 | 2-ethylmercaptopyrimidine |
| 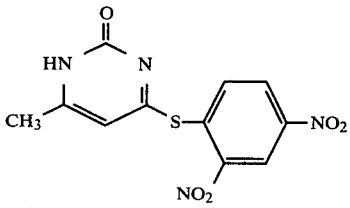 | 6-(2,4-dinitrophenylmercapto)-4-methyl-2-pyrimidone |
| 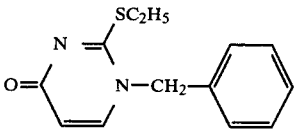 | 1-benzyl-2-ethylmercapto-4-pyrimidone |
| 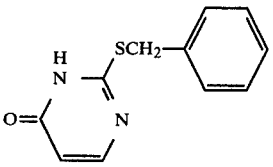 | 2-benzylmercapto-4-pyrimidone |
| 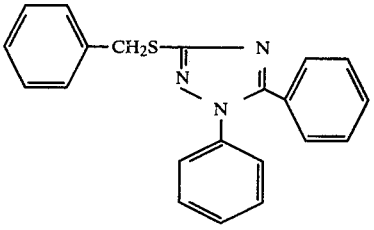 | 3-benzylmercapto-1,5-diphenyl-1,2,4-triazole |

Table 2-continued

| Sulfur compounds of formula (2) | |
|---|---|
| Compound | |
| 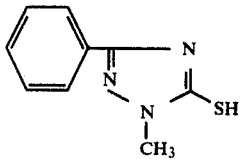 | 1-methyl-5-mercapto-3-phenyl-1,2,4-triazole |
| 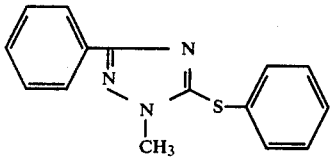 | 1-methyl-5-phenylmercapto-3-phenyl-1,2,4-triazole |
| 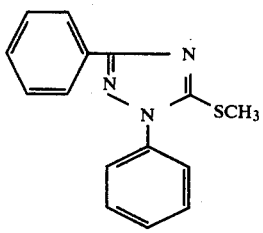 | 5-methylmercapto-1,3-diphenyl-1,2,4-triazole |
| 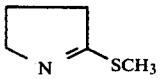 | 2-methylmercaptopyrroline |
| 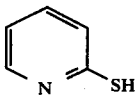 | 2-mercaptopyridine |
| 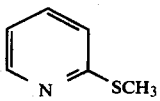 | 2-methylmercaptopyridine |
| 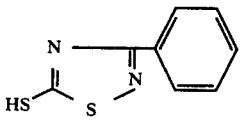 | 3-phenyl-5-mercapto-1,2,4-thiadiazole |
| 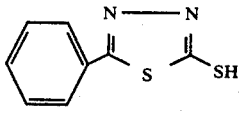 | 5-phenyl-2-mercapto-1,3,4-thiadiazole |
| 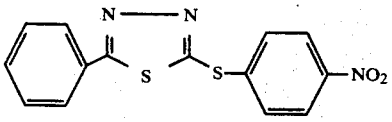 | 5-phenyl-2-p-nitrophenylmercapto-1,3,4-thiadiazole |
| 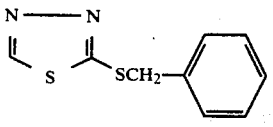 | 2-benzylmercapto-1,3,4-thiadiazole |

Table 2-continued

| Sulfur compounds of formula (2) | |
|---|---|
| Compound | |
| 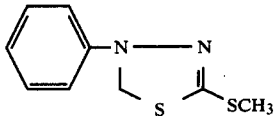 | 4-phenyl-2-methylmercapto-1,3,4-thiadiazoline |
| 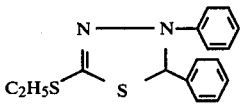 | 5-ethylmercapto-2,3-diphenyl-1,3,4-thiadiazoline |
| 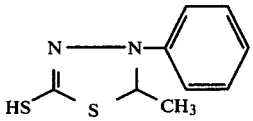 | 3-phenyl-5-mercapto-2-methyl-1,3,4-thiadiazoline |
| 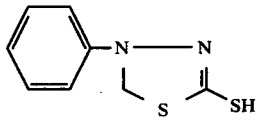 | 4-phenyl-2-mercapto-1,3,4-thiadiazoline |
| 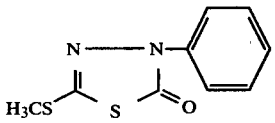 | 3-phenyl-5-methylmercapto-1,3,4-thiadiazoline-2-one |
| 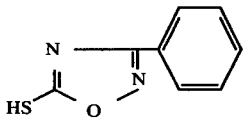 | 3-phenyl-5-mercapto-1,2,4-oxadiazole |
| 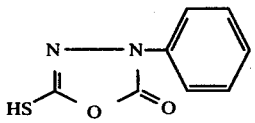 | 3-phenyl-5-mercapto-1,3,4-oxadiazole-2-one |
| 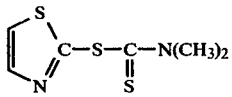 | dimethyldithiocarbamic acid 2-thiazolyl ester |
| 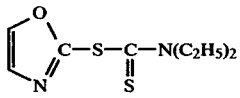 | diethyldithiocarbamic acid 2-oxazolyl ester |
| 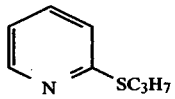 | 2-propylmercaptopyridine |
| 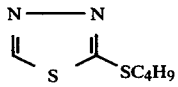 | 2-butylmercapto-1,3,4-thiadiazole |
| 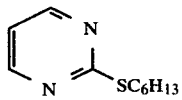 | 2-hexylmercaptopyrimidine |

Table 2-continued

| Sulfur compounds of formula (2) Compound | |
|---|---|
| 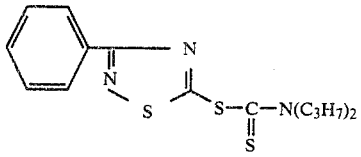 | dipropyldithiocarbamic acid 5-(1,2,4-thiadiazolyl) ester |
| 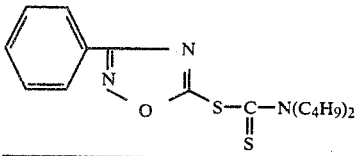 | dibutyldithiocarbamic acid 5-(1,2,4-oxadiazolyl) ester |

Table 3

| Sulfur compounds of formula (3) | | |
|---|---|---|
| $R_1$ | $R_2$ | Compound |
| $CH_3$— | $CH_3$— | tetramethylthiuram disulfide |
| $C_2H_5$— | $C_2H_5$— | tetraethylthiuram disulfide |
| $C_4H_9$— | $C_4H_9$— | tetrabutylthiuram disulfide |
| 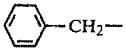 | 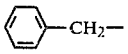 | tetrabenzylthiuram disulfide |
| 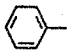 | $C_2H_5$— | bis(ethylphenylthiuram) disulfide |
| $C_6H_{13}$— | $C_6H_{13}$— | tetrahexylthiuram disulfide |
| $C_7H_{15}$— | $C_7H_{15}$— | tetraheptylthiuram disulfide |
| $C_8H_{17}$— | $C_8H_{17}$— | tetraoctylthiuram disulfide |
| $C_4H_9$— | $C_8H_{17}$— | bis(butyloctylthiuram) disulfide |
| $C_2H_5$— | 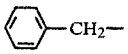 | bis(ethylbenzylthiuram) disulfide |
| $CH_3$— | $C_6H_{13}$— | bis(methylhexylthiuram) disulfide |

TABLE 4

| Sulfur compounds of formula (4) | |
|---|---|
| $R_3$ | Compound |
| $CH_3$— | bismethylxanthogen |
| $C_2H_5$— | bisethylxanthogen |
| $C_3H_7$— | bispropylxanthogen |
| $C_4H_9$— | bisbutylxanthogen |
| $C_5H_{11}$— | bispentylxanthogen |
| $C_6H_{13}$— | bishexylxanthogen |
| $C_7H_{15}$— | bisheptylxanthogen |
| $C_8H_{17}$— | bisoctylxanthogen |
| 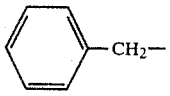 | bisbenzylxanthogen |

Table 5

| Sulfur compounds of formula (5) | |
|---|---|
| $R_4$ | Compound |
| 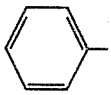 | dibenzoyl disulfide |
| 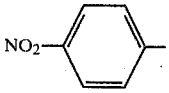 | 4,4'-dinitrodibenzoyl disulfide |
| 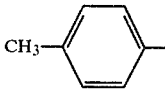 | 4,4'-dimethyldibenzoyl disulfide |
| 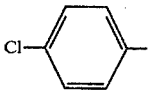 | 4,4'-dichlorodibenzoyl disulfide |
| 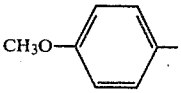 | 4,4'-dimethoxydibenzoyl disulfide |
| $CH_3$— | diacetyl disulfide |
| $C_2H_5$— | dipropionyl disulfide |
| $C_3H_7$— | dibutanoyl disulfide |
| $C_4H_9$— | dipentanoyl disulfide |
| $C_5H_{11}$ | dihexanoyl disulfide |
| $C_6H_{13}$— | diheptanoyl disulfide |
| $C_7H_{15}$— | dioctanoyl disulfide |
| $C_8H_{17}$— | dinonanoyl disulfide |
| 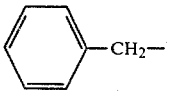 | di(phenylacetyl) disulfide |

TABLE 6

| Sulfur compounds of formula (6) | | | |
|---|---|---|---|
| $R_5$ | $R_6$ | x | Compound |
| $-CH_2-$ | $-CH_2-$ | 1 | thiodiglycolic acid |
| $-CH_2-$ | $-CH_2-$ | 2 | dithioglycolic acid |
| $-CH(CH_3)-$ | $-CH(CH_3)-$ | 2 | α,α'-dithiodipropionic acid |
| $(CH_2)_2$ | $(CH_2)_2$ | 2 | β,β'-dithiodipropionic acid |
| $-CH_2-$ | $-CH_2-$ | 3 | trithiodiglycolic acid |
| $-CH_2-$ | $-CH_2-$ | 4 | tetrathiodiglycolic acid |
| $-CH_2-$ | $(CH_2)_2$ | 1 | methylethylsulfide-α,β'-dicarboxylic acid |
| $-CH_2-$ | $-CH(CH_3)-$ | 1 | methylethylsulfide-α,α'-dicarboxylic acid |
| $(CH_2)_2$ | $(CH_2)_4$ | 1 | ethylbutylsulfide-β,δ'-dicarboxylic acid |
| $(CH_2)_8$ | $(CH_2)_8$ | 1 | dioctylsulfide-θ,θ'-dicarboxylic acid |
| $(CH_2)_4$ | $(CH_2)_8$ | 1 | butyloctylsulfide-δ,θ'-dicarboxylic acid |
| $(CH_2)_6$ | $(CH_2)_6$ | 1 | dihexylsulfide-ζ,ζ'-dicarboxylic acid |

The heat developable photosensitive composition containing an organic silver salt according to the present invention may be prepared by using at least one of sulfur compounds of formulas (1), (2), (3), (4), (5) and (6), organic silver salt and halide. Usually, these components are dispersed in an insulating medium by using an appropriate solvent and applied to a substrate to form a heat developable photosensitive layer.

The heat developable photosensitive member may be formed, for example, in such a manner that a reducing agent is mixed with a resin by means of an appropriate solvent and coated onto the above-mentioned heat developable photosensitive layer.

The substrate may be a metal plate such as aluminum, copper, zinc, silver and the like, a metal laminate paper, a paper treated so as to prevent a solvent from penetrating, a paper treated with a conductive polymer, and plastics.

The silver halide or sulfur compound of formula (1), (2), (3), (4), (5) or (6) may be incorporated to a layer containing the organic silver salt (first layer), or coated on the layer in a form of the coating liquid prepared by means of an appropriate solvent, or incorporated to a layer adjacent to the layer. Further, the sulfur compound of formula (1), (2), (3), (4), (5) or (6) may be incorporated upon producing the organic silver salt, or added to a dispersion liquid of the organic silver salt, or coated, together with a reducing agent, on the layer containing the organic silver salt.

Representative organic silver salts used in the present invention are aliphatic acid silver salts containing not less than 25 carbon atoms such as silver behenate, silver arachidate, silver stearate, silver palmitate, silver myristate, silver laurate, silver caprylate, silver hydroxystearate, silver acetate, and silver butyrate, and other organic silver compounds such as silver benzoate, silver 4-n-octadecyloxydiphenyl-4-carboxylate, silver-o-aminobenzoate, silver acetoamidobenzoate, silver furoate, silver camphorate, silver p-phenylbenzoate, silver phenyl acetate, silver salicylate, silver terephthalate, silver phthalate, silver acid phthalate, silver phthalazinone, silver benzotriazole, silver saccharine and the like.

For the purpose of imparting a photosensitivity to the organic silver salts, a halide as shown below may be applied to form the silver halide: various inorganic halides such as $NH_4X$, $CrX_2$, $IrX_4$, $InX_4$, $CoX_2$, $CdX_2$, KX, HX, $SnX_2$, $SnX_4$, $SrX_2$, $SO_2X_2$, $TiX_3$, $TiX_4$, $CuX_2$, NaX, $PbX_2$, $NiX_2$, $PdX_2$, $MgX_2$, $AlX_3$, $ZnX_2$, $MnX_2$, $BaX_2$, $KAuX_4$, $HAuX_4$, $BiX_3$, CsX, $FeX_3$, AgX, $HgX_2$, $CaX_2$ and the like where X is chloro, bromo or iodo.

The amount of the halide may be optionally selected depending upon each purpose. It is preferably not higher than 10% by weight based on the organic silver salt, more preferably $10^{-3}$–10% by weight.

If desired, dye sensitizers, toning agents, stabilizers and other additives may be incorporated.

The developing procedure may be conducted by preliminarily incorporating a reducing agent such as substituted phenols, substituted naphthols and the like to the heat developable photosensitive layer or coating it on the surface of the heat developable photosensitive layer and heat-developing.

Representative reducing agents are: hydroquinone, methyl hydroquinone, chlorohydroquinone, bromohydroquinone, catechol, pyrogallol, methylhydroxynaphthalene, aminophenol, 2,2'-methylene-bis-(6-t-butyl-4-methylphenol), 4,4'-butylidene-bis-(6-t-butyl-3-methylphenol), 4,4'-bis-(6-t-butyl-3-methylphenol), 4,4'-thio-bis-(6-t-2-methylphenol), octadecyl 3-(3',5'-di-t-butyl-4'-hydroxyphenyl)propionate, 2,6-di-t-butyl-p-cresol, 2,2'-methylene-bis-(4-ethyl-6-t-butylphenol), phenidone, metol, 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis-(2-hydroxy-1-naphthyl)methane and mixtures thereof.

For example, these reducing agents may be mixed with a resin such as cellulose acetate by using an optional solvent and applied to a surface of the layer containing the organic silver salt to form a layer containing the reducing agent (second layer).

It is also possible to carry out a developing procedure without incorporating a developing agent (a reducing agent) to the heat developable photosensitive member, that is, it is possible to effect an external type of wet developing procedure. For example, a developing solution containing a reducing agent as mentioned above is applied to a buffer solution adjusted to a low pH. Fixing may be effected with a usual solution of sodium thiosulfate.

As the solvents for dispersing the organic silver salt in an insulating medium, there may be mentioned methylene chloride, chloroform, dichloroethane, 1,1,2-trichloroethane, trichloroethylene, tetrachloroethane, carbon tetrachloride, 1,2-dichloropropane, 1,1,1-trichloroethane, tetrachloroethylene, ethyl acetate, butyl acetate, isoamyl acetate, cellosolve acetate, toluene xylene, acetone, methyl ethyl ketone, dioxane, tetrahydrofuran, dimethylamide, N-methyl-pyrrolidone, alcohols such as methyl alcohol, ethyl alcohol, isopropyl alcohol, butyl alcohol and the like, and water.

As the insulating medium used in the present invention, the electrically-insulating materials may be used. For example, there may be mentioned polystyrene resin, polyvinyl chloride resin, phenolic resin, polyvinyl acetate resin, polyvinyl acetal resin, epoxy resin, xylene resin, alkyd resin, polycarbonate resin, poly(methylmethacrylate) resin, polyvinyl butyral resin, gelatine resin, polyester, polyurethane, acetyl cellulose, synthetic rubber, polybutene, and the like.

If desired, there may be added a plasticizer. As the plasticizer, there may be mentioned dioctyl phthalate, tricresyl phosphate, diphenyl chloride, methyl naphthalene, p-terphenyl, diphenyl and the like.

The amount of the insulating medium upon forming the photosensitive layer is usually 0.02–20 parts by weight, preferred with 0.1–5 parts by weight, per one part by weight of the organic silver salt compound.

The total thickness of the first layer containing the silver salt and the second layer containing the reducing agent may be optionally determined in view of the purpose, use and durability, and it may be usually in the range of from 1 micron to 50 microns, more preferably from 2 microns to 30 microns.

The invention will be understood more readily by reference to the following examples. However, these examples are intended to illustrate the invention and are not to be construed to limit the scope of the invention.

EXAMPLE 1

In a ball mill, 10 g. of silver behenate, 150 g. of methyl ethyl ketone, 150 g. of toluene and 15 g. of silica powder (Syloid #244, a trade name for a product of Fuji Davison Chemical Ltd.) were mixed, pulverized and dispersed for 72 hours. Then, 9 g. of polyvinyl butyral resin (S-Lec BM-1, a trade name for a product of Sekisui Kagaku K.K.) was added to the resulting dispersed mixture and further ball-milled for 15 minutes. 20 mg. of 2-mercaptobenzoxazole (the sulfur compound) in 10 ml. of acetone was added thereto and sufficiently uniformly mixed to prepare a first composition. The resulting mixture was coated onto a two-sided art paper of 100 microns in thickness with a coating rod so as to be 8 microns in thickness after drying.

In 19 g. of acetone were mixed and dissolved 1 g. of 2,6-di-t-butyl-p-cresol, 0.5 g. of 1-phthalazone, 1 g. of acetyl cellulose (Daicel L-30, a trade name for a product of Daicel Ltd.) and 5 mg. of ammonium bromide, and the resulting solution (second composition) was coated onto the silver behenate-containing layer formed in the foregoing at a dark place in a thickness of 4 microns after drying to prepare a heat developable photosensitive member, Sample-A.

On the other hand, Sample-B for comparison was prepared in the same manner as that mentioned above except that no 2-mercaptobenzoxazole was used in forming the silver behenate-containing layer.

The above-mentioned Samples-A and B were exposed to a tungsten light source (1500 lux) and heat-developed by using a roller type heat developing apparatus to form visualized images. The density of the images was measured by means of a densitometer (supplied by Nalumi Ltd.) to make a comparison with respect to various characteristics of the samples. The results are shown in the following table.

I. Relative Sensitivity etc.
(Exposure time: 20 sec., Heat development for 3 sec. at 120° C.)

| | Sample-A | Sample-B |
|---|---|---|
| (a) Relative Sensitivity | 16 | 1 |
| (b) Maximum Density ($D_{max}$) | 1.3 | 0.5 |
| (c) Fog Density ($D_{min}$) | 0.2 | 0.1 |
| (d) Shelf-life* | 200 days | 30 days |

II. Development Latitude (Exposure time: 10 sec.)

| Developing time (at 120° C.) | Sample-A | | Sample-B | |
|---|---|---|---|---|
| | $D_{max}$ | $D_{min}$ | $D_{max}$ | $D_{min}$ |
| 1 sec. | 0.2 | 0.1 | 0.1 | 0.1 |
| 2 sec. | 0.6 | 0.1 | 0.2 | 0.1 |
| 3 sec. | 1.1 | 0.2 | 0.5 | 0.1 |
| 4 sec. | 1.2 | 0.2 | 0.6 | 0.4 |
| 5 sec. | 1.3 | 0.2 | 0.6 | 0.5 |

-continued

| Developing Temperature (Developing time of 3 sec.) | Sample-A | | Sample-B | |
|---|---|---|---|---|
| | $D_{max}$ | $D_{min}$ | $D_{max}$ | $D_{min}$ |
| 100° C. | 0.5 | 0.1 | 0.1 | 0.1 |
| 110° C. | 0.7 | 0.1 | 0.2 | 0.1 |
| 120° C. | 1.1 | 0.2 | 0.5 | 0.1 |
| 130° C. | 1.3 | 0.3 | 0.6 | 0.4 |
| 150° C. | 1.4 | 0.8 | 0.6 | 0.6 |

*Period of time required for reduction of sensitivity by half.

In the above table, the relative sensitivities were obtained in such a manner that the Samples were exposed through a grey scale and subjected to heat development and then the density of the obtained images was measured by a densitometer (supplied by Nalumi Ltd.) to calculate the relative sensitivities from the relation between the exposure amount and the density. The maximum density represents the density of the image obtained by exposing the samples to the above-mentioned light source for a predetermined time without the use of a grey scale followed by the development. The fog density represents the density of the unexposed portion after the heat-development. The shelf-life is the period of time required for reduction of the sensitivity by half.

EXAMPLE 2

Photosensitive members were prepared in the same procedure as that in Example 1 except that various compounds of the general formulas (1), (2) and (6) were used as the sulfur compound, and the wavelength edge of the photosensitivity range and relative sensitivities were measured, the results of which are shown in the following table. In this connection, the photosensitive member having the layer containing 4-chloro-2-benzylmercaptopyrimidine was selected as the standard for evaluating the sensitivity, that is, 1. In addition, the measurement of the wavelength edge of the photosensitivity range was conducted by a grating spectrograph (RM-23-1, a trade name for a product of Nalumi Ltd.) provided with a xenon light source. The other measurement was conducted in the same manner as that in Example 1.

| Sulfur Compound | Wavelength edge of photo-sensitivity range (nm) | Relative Sensitivity |
|---|---|---|
| None | 470 | 0.06 |
| 1. Sulfur compound of the general formula (1): | | |
| 2-mercaptobenzothiazole | 510 | 1.1 |
| 2-(2,4-dinitrophenylmercapto) benzothiazole | 530 | 1.2 |
| 2-mercaptobenzimidazole | 500 | 0.9 |
| 2-mercaptobenzoxazole | 510 | 1.0 |
| 2. Sulfur compound of the general formula (2): | | |
| 2-mercaptothiazoline | 490 | 0.5 |
| 2-mercaptoimidazole | 500 | 0.8 |
| 2-methylmercapto-4,5-diphenylimidazole | 510 | 0.4 |
| 2-methylmercaptoimidazoline | 490 | 0.8 |
| *4-chloro-2-benzylmercapto-pyrimidine | 500 | 1.0 |
| 6-(2,4-dinitrophenylmercapto)-4-methyl-2-pyrimidone | 510 | 1.1 |
| 3-phenyl-5-mercapto-1,2,4-thiodiazole | 500 | 0.8 |

-continued

| Sulfur Compound | Wavelength edge of photo-sensitivity range (nm) | Relative Sensitivity |
|---|---|---|
| diethyldithiocarbamic acid 2-oxazolyl ester | 520 | 1.2 |
| 3. Sulfur compound of the general formula (6): | | |
| dithioglycolic acid | 490 | 0.4 |
| β,β'-dithiodipropionic acid | 490 | 0.5 |
| tetrathiodiglycolic acid | 510 | 0.07 |

*Standard

EXAMPLE 3

A heat developable photosensitive member was prepared in the same manner as that in Example 1 except that 17 g. of an equimolar mixture of silver behenate and behenic acid was used in place of 10 g. of the silver behenate. When the photosensitive member thus prepared was exposed under the same condition as that in Example 1, a developing time of 6 seconds (at 120° C.) was required to obtain the maximum density (1.3) of the image which was obtained by the heat development at 120° C. for 3 seconds in Example 1. On the other hand, the fog density was 0.15 or less so that the development latitude was found to be improved.

EXAMPLE 4

To the second composition used in Example 1 containing 2,6-di-t-butyl-p-cresol was added 5 mg. of a dye sensitizer of the formula:

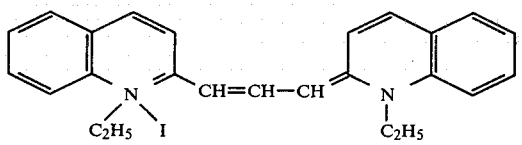

The same procedure as that for preparing Sample-A was repeated except that the above-mentioned composition was used in place of the second composition to prepare Sample-C.

The characteristics of Sample-C were measured in the same manner as that in Example 1 to obtain the results shown in the following table.

| | Sample-A | Sample-C |
|---|---|---|
| Relative Sensitivity | 1 | 3.0 |
| Maximum Density | 1.3 | 1.3 |
| Fog Density | 0.2 | 0.3 |
| Wavelength edge of photosensitivity range | 510 nm | 650 nm |

(Exposure time: 20 sec., Heat development for 3 sec. at 120° C.)

EXAMPLE 5

In a ball mill, 10 g. of silver behenate, 75 g. of methyl ethyl ketone and 75 g. of toluene were mixed, pulverized and dispersed for 72 hours. Then, 7 g. of polyvinyl butyral resin (S-Lec BM-1, a trade name for a product of Sekisui Kagaku K.K.) was added to the resulting dispersed mixture and further ball-milled for 15 minutes. 2 mg. of dibenzoyl disulfide (the sulfur compound) in 2 ml. of acetone was added thereto and sufficiently uniformly mixed to prepare a first composition.

The resulting mixture was coated onto a two-sided art paper of 100 microns in thickness with a coating rod in a thickness of 8 microns after drying.

In 19 g. of acetone were mixed and dissolved 1 g. of 2,6-di-t-butyl-p-cresol, 0.5 g. of 1-phthalazone, 1 g. of acetyl cellulose (Daicel L-30, a trade name for a product of Daicel Ltd.) and 5 mg. of ammonium bromide, and the resulting solution (second composition) was coated onto the silver behenate-containing layer formed in the foregoing at a dark place in a thickness of 4 microns after drying to prepare Sample-D.

On the other hand, Sample-E for comparison was prepared in the same manner as that mentioned above except that no dibenzoyl disulfide was used in forming the silver behenate-containing layer.

The above-mentioned Samples-D and E were exposed to a tungsten light source (1500 lux) and heat-developed by using a roller type heat developing apparatus to form visualized images. The density of the images was measured by means of a densitometer (supplied by Nalumi Ltd.) to make a comparison with respect to various characteristics of the samples in the same manner as that in Example 1. The results are shown in the following table.

I. Relative Sensitivity etc.
(Exposure time: 30 sec., Heat development for 3 sec. at 140° C.

| | Sample-D | Sample-E |
|---|---|---|
| (a) Relative Sensitivity | 20 | 1 |
| (b) Maximum Density ($D_{max}$) | 1.6 | 0.6 |
| (c) Fog Density ($D_{min}$) | 0.2 | 0.2 |
| (d) Shelf-life* | 180 days | 30 days |

II. Development Latitude
(Exposure time: 30 sec.)

| Developing time (at 140° C.) | Sample-D | | Sample-E | |
|---|---|---|---|---|
| | $D_{max}$ | $D_{min}$ | $D_{max}$ | $D_{min}$ |
| 1 sec. | 0.2 | 0.1 | 0.1 | 0.1 |
| 2 sec. | 0.9 | 0.1 | 0.2 | 0.1 |
| 3 sec. | 1.6 | 0.2 | 0.6 | 0.2 |
| 4 sec. | 1.6 | 0.3 | 0.6 | 0.4 |
| 5 sec. | 1.7 | 0.3 | 0.7 | 0.5 |
| **Developing Temperature (Developing time of 3 sec.)** | **Sample-D** | | **Sample-E** | |
| | $D_{max}$ | $D_{min}$ | $D_{max}$ | $D_{min}$ |
| 110° C. | 0.4 | 0.1 | 0.3 | 0.1 |
| 120° C. | 1.0 | 0.1 | 0.5 | 0.1 |
| 140° C. | 1.6 | 0.2 | 0.6 | 0.2 |
| 150° C. | 1.7 | 0.3 | 0.7 | 0.3 |

*Period of time required for reduction of sensitivity by half.

EXAMPLE 6

Heat developable photosensitive members were prepared in the same procedure as that in Example 5 except that various compounds were used as the sulfur compound, and the wavelength edge of the photosensitivity range and relative sensitivities were measured, the results of which are shown in the following table. In this connection, the heat developable photosensitive member having the layer containing dibenzoyl disulfide was selected as the standard for evaluating the sensitivity, that is, 1. In addition, the measurement of the wavelength edge of the photosensitivity range was conducted by a grating spectrograph (RM-23-1, a trade name for a product of Nalumi Ltd.) provided with a xenon light source. The other measurement was conducted in the same manner as that in Example 1.

| Sulfur Compound | Wavelength edge of photo-sensitivity range (nm) | Relative Sensitivity |
|---|---|---|
| None | 470 | 0.5 |
| 1. Sulfur compound of the general formula (3): | | |
| Tetramethylthiuram disulfide | 520 | 0.7 |
| Tetrabutylthiuram disulfide | 520 | 1.0 |
| Bis(ethylphenylthiuram) disulfide | 510 | 1.2 |
| 2. Sulfur compound of the general formula (4): | | |
| Bisethylxanthogen | 510 | 0.5 |
| Bisbenzylxanthogen | 520 | 0.8 |
| 3. Sulfur compound of the general formula (5): | | |
| *Dibenzoyl disulfide | 510 | 1.0 |
| 4,4'-dimethyldibenzoyl disulfide | 520 | 1.2 |
| 4,4'-dichlorodibenzoyl disulfide | 510 | 0.8 |
| Diacetyl disulfide | 500 | 0.5 |
| Di(phenylacetyl disulfide | 510 | 1.1 |

*Standard

EXAMPLE 7

A heat developable photosensitive member was prepared in the same procedure as that in Example 5 except that 17 g. of an equimolar mixture of silver behenate and behenic acid was used in place of 10 g. of silver behenate.

The photosensitive member thus prepared was exposed under the same condition as that in Example 5, in case of which a developing time of 5 seconds (at 140° C.) was necessary to obtain the same maximum density (1.6) of the image which was obtained by the heat development at 140° C. for 3 seconds in Example 5. On the other hand, the fog density was 0.15 or less. Thus the development latitude was found to be further improved.

EXAMPLE 8

To the second composition used in Example 5 containing a reducing agent (2,6-di-t-butyl-p-cresol) was added 3 mg. of a dye sensitizer of the formula:

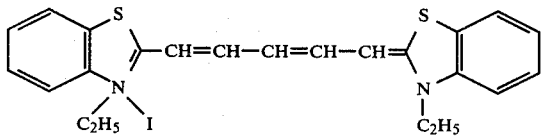

The same procedure as that for preparing Sample-D in Example 5 was repeated except that the above-mentioned composition was substituted for the second composition to prepare Sample-F.

This sample was measured with respect to the characteristics in the same manner as that in Example 5 to obtain the results shown in the following table.

| | Sample-D | Sample-E |
|---|---|---|
| Relative Sensitivity | 1 | 4.2 |
| Maximum Density ($D_{max}$) | 1.6 | 1.7 |
| Fog Density | 0.2 | 0.3 |
| Wavelength edge of photosensitivity range | 510 nm | 720 nm |

(Exposure time: 30 sec., Heat development for 3 sec. at 140° C.)

EXAMPLE 9

In the same procedure as that in Example 2, various sulfur compounds of the general formulas (1)–(6) were used to prepare heat developable photosensitive members and their relative sensitivities were measured. The results are shown below. In this connection, the photosensitive member having the layer containing 2-butylmercaptobenzothiazole was selected as the standard for evaluating the sensitivity, that is, 1.

| Sulfur Compound | Relative Sensitivity |
|---|---|
| 1. Sulfur compound of the general formula (1): | |
| 2-phenylmercaptobenzothiazole | 0.7 |
| 2-mercapto-4,5-benzo-1,3-thiazine | 0.5 |
| 2-ethylmercaptobenzoxazole | 0.9 |
| 2-(p-nitrophenylmercapto)benzoxazole | 0.9 |
| dibenzyldithiocarbamic acid 2-benzothiazolyl ester | 0.8 |
| *2-butylmercaptobenzothiazole | 1.0 |
| 2-hexylmercaptobenzothiazole | 0.9 |
| 2-penthylmercaptobenzoxazole | 0.9 |
| dibutyldithiocarbamic acid 2-benzimidazolyl ester | 1.1 |
| 2. Sulfur compound of the general formula (2): | |
| 1-methyl-5-nitro-2-methylmercaptoimidazole | 0.8 |
| 1-phenyl-2-methylmercapto-4,4-dimethyl-5-imidazoline | 0.9 |
| 3-methylmercapto-1,5-dimethylpyrazole | 1.0 |
| 1-phenyl-3-methylmercapto-5-methylpyrazole | 0.8 |
| 2-methylmercaptothiazoline | 0.8 |
| 2-ethylmercaptoimidazole | 1.0 |
| 3-propylmercapto-1,5-dimethylpyrazole | 1.1 |
| 2-pentylmercaptoimidazoline | 0.9 |
| 2-hexylmercaptoimidazole | 1.1 |
| 2-phenylmercaptothiazoline | 0.7 |
| 2-benzylmercaptoimidazole | 0.8 |
| diethyldithiocarbamic acid 2-imidazolyl ester | 0.9 |
| 4,6-dichloro-2-methylmercaptopyrimidine | 0.7 |
| 2-ethylmercaptopyrimidine | 0.7 |
| 6-(2,4-dinitrophenylmercapto)-4-methyl-2-pyrimidone | 0.6 |
| 1-benzyl-2-ethylmercapto-4-pyrimidone | 0.8 |
| 2-benzylmercapto-4-pyrimidone | 0.7 |
| 3-benzylmercapto-1,5-diphenyl-1,2,4-triazole | 0.8 |
| 1-methyl-5-phenylmercapto-3-phenyl-1,2,4-triazole | 0.8 |
| 2-methylmercaptopyrroline | 0.5 |
| 2-mercaptopyridine | 0.6 |
| 5-phenyl-2-mercapto-1,3,4-thiadiazole | 0.7 |
| 5-phenyl-2-p-nitrophenylmercapto-1,3,4-thiadiazole | 0.6 |
| 2-benzylmercapto-1,3,4-thiadiazole | 1.0 |
| 5-ethylmercapto-2,3-diphenyl-1,3,4-thiadiazoline | 1.2 |
| 4-phenyl-2-mercapto-1,3,4-thiadiazoline | 0.9 |
| 3-phenyl-5-mercapto-1,2,4-oxadiazole | 0.8 |
| dimethyldithiocarbamic acid 2-thiazolyl ester | 1.1 |
| 2-butylmercapto-1,3,4-thiadiazole | 0.9 |
| 2-hexylmercaptopyrimidine | 1.0 |
| dipropyldithiocarbamic acid 5-(1,2,4-thiadiazolyl) ester | 1.1 |
| dibutyldithiocarbamic acid 5-(1,2,4-oxadiazolyl) ester | 1.0 |
| 3. Sulfur compound of the general formula (3): | |
| tetrabenzylthiuram disulfide | 0.7 |
| tetrahexylthiuram disulfide | 0.9 |
| tetraheptylthiuram disulfide | 0.8 |
| tetraoctylthiuram disulfide | 1.0 |
| bis(butyloctylthiuram) disulfide | 1.1 |

-continued

| Sulfur Compound | Relative Sensitivity |
|---|---|
| bis(ethylbenzltiuram) disulfide | 0.9 |
| bis(methylhexylthiuram) disulfide | 0.9 |
| 4. Sulfur compound of the general formula (4): | |
| bismethlxanthogen | 0.6 |
| bispropylxanthogen | 0.7 |
| bispentylxanthogen | 0.5 |
| bishexylxanthogen | 0.7 |
| bisoctylxanthogen | 0.5 |
| 5. Sulfur compound of the general formula (5): | |
| 4,4'-dimethoxdibenzoyl disulfide | 1.2 |
| dipropionyl disulfide | 1.1 |
| dipentanoyl disulfide | 1.1 |
| dihexanol disulfide | 1.3 |
| diheptanoyl disulfide | 1.2 |
| dinonanoyl disulfide | 1.1 |
| 6. Sulfur compound of the general formula (6): | |
| methylethylsulfide-$\alpha,\beta'$-dicarboxylic acid | 0.6 |
| methylethylsulfide-$\alpha,\beta'$-dicarboxylic acid | 0.6 |
| dioctylsulfide-$\theta$, $\theta'$-dicarboxylic acid | 0.8 |
| dihexylsulfide-$\zeta$, $\zeta'$-dicarboxylic acid | 0.8 |
| thiodiglycolic acid | 0.7 |
| $\alpha,\alpha'$-dithiodipropionic acid | 0.6 |

*Standard

EXAMPLE 10

In a ball mill, 20 g. of silver behenate, 150 g. of methyl ethyl ketone and 150 g. of toluene were mixed, pulverized for 72 hours to prepare a uniform slurry. Then, 100 g. of a 20% solution of a polyvinyl butyral resin (S-Lec BM-1, a trade name for a product of Sekisui Kagaku K.K.) in ethyl alcohol was added to the slurry and gently mixed for about three hours. 0.12 g. of mercury acetate, 0.2 g. of calcium bromide and 5.0 g. of phthalazinone were successively added to the mixture. 20 mg. of 2-mercaptobenzoxazole (the sulfur compound) in 10 ml. of acetone was added thereto and sufficiently uniformly mixed to prepare a first composition. The resulting mixture was uniformly coated onto an aluminum plate having a thickness of 100 microns with a coating rod in a thickness of 10 microns after drying.

The mixed solution of the following composition (second composition) was coated onto the silver behenate layer formed in the foregoing at a dark place in a thickness of 3 microns after drying to prepare Sample-G.

| | |
|---|---|
| 2,2'-methylene-bis-6-t-butyl-p-cresol | 1.5 g. |
| Phthalazinone | 0.3 g. |
| Acetyl cellulose (Daicel L-30, a trade name for a product of Daicel Ltd.), acetone 10% solution | 10 g. |
| Acteone | 15 g. |
| Dye sensitizer | 0.005 g. |

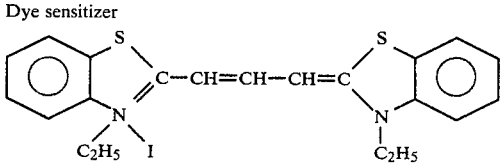

On the other hand, Sample-H for comparison was prepared in the same manner as that mentioned above except that no 2-mercaptobenzoxazole was used in forming the silver behenate-containing layer.

The above-mentioned Samples-A and B were exposed to a tungsten light source (60 lux) through a positive image for two seconds, and then a heating apparatus of a roller type was used to carry out the development so that a negative print was obtained by heating at 130° C. for two seconds.

Relative sensitivity was measured in the same manner as that in Example 1. The results are shown below.

| | Sample-G | Sample-H |
|---|---|---|
| Relative Sensitivity | 17 | 1 |

EXAMPLE 11

In a ball mill, 15 g. of silver behenate, 100 g. of methyl ethyl ketone and 100 g. of toluene were mixed, pulverized and dispersed for 100 hours. Then, 15 g. of acetyl cellulose was added to the resulting disperse mixture and further ball-milled for 20 minutes. 7.5 mg. of ammonium bromide was successively added to the resulting mixture and uniformly mixed to prepare a first composition.

The first composition was uniformly coated onto an aluminum foil having a thickness of 80 microns with a coating rod in a thickness of 15 microns after drying.

In 19 g. of acetone were mixed and dissolved 1 g. of 2,6-di-t-butyl-p-cresol, 0.5 g. of 1-phthalazone, 1 g. of acetyl cellulose and 2 mg. of dibenzoyl disulfide (the sulfur compound), and the resulting solution (second composition) was coated onto the silver behenate-containing layer formed in the foregoing at a dark place in a thickness of 5 microns after drying to prepare Sample-I.

On the other hand, Sample-J for comparison was prepared in the same manner as that mentioned above except that no dibenzoyl disulfide was used in forming the silver behenate-containing layer.

The above-mentioned Samples-I and J were exposed to a tungsten light source (1500 lux) for 30 seconds and heat-developed for 3 seconds at 120° C. by using a roller type heat developing apparatus to form visualized images.

Relative sensitivity was measured in the same manner as that in Example 1. The results are shown below.

| | Sample-I | Sample-J |
|---|---|---|
| Relative Sensitivity | 20 | 1 |

What is claimed is:

1. A heat developable photosensitive composition adapted to form metallic silver grains at exposed portions in cooperation with a reducing agent comprising an organic silver salt, a halide and, as a compound to enhance formation of metallic silver grains at exposed portions and suppress formation of metallic silver grains at non-exposed portions, at least one member of sulfur compounds having the formula (1):

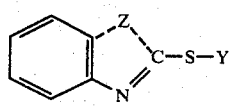

(1)

in which Y is selected from the class of hydrogen, alkyl, unsubstituted or substituted phenyl, aralkyl and

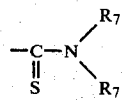

wherein $R_7$ is benzyl, Z is one or more atoms necessary for forming a 5- or 6-membered heterocyclic ring which may be substituted or unsubstituted.

2. A heat developable photosensitive composition according to claim 1 in which Y is an alkyl having 1–6 carbon atoms.

3. A heat developable photosensitive composition according to claim 1 in which Y is benzyl.

4. A heat developable photosensitive composition according to claim 1 in which the sulfur compound is contained in an amount of $10^{-4}$–$10^{-1}$ part by weight per one part by weight of the organic silver salt.

5. A heat developable photosensitive composition according to claim 1 in which the sulfur compound is contained in an amount of $5\times10^{-4}$–$10^{-2}$ parts by weight per one part by weight of the organic silver salt.

6. A heat developable photosensitive member adapted to form metallic silver grains at exposed portions comprising a layer containing a reducing agent and a layer containing an organic silver salt, a halide, an insulating medium and as a compound to enhance formation of metallic silver grains at exposed portions and suppress formation of metallic silver grains at non-exposed portions, at least one member of sulfur compounds having the formula (1):

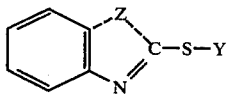

(1)

in which Y is selected from the class of hydrogen, alkyl, having 1–6 carbon atoms, unsubstituted or substituted phenyl, benzyl

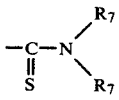

wherein $R_7$ is benzyl, Z is one or more atoms necessary for forming a 5- or 6-membered heterocyclic ring which may be substituted or unsubstituted, the former layer overlying the latter layer.

7. A heat developable photosensitive member according to claim 6 in which the sulfur compound is contained in an amount of $10^{-4}$–$10^{-1}$ part by weight per one part by weight of the organic silver salt.

8. A heat developable photosensitive member according to claim 6 in which the sulfur compound is contained in an amount of $5\times10^{-4}$–$10^{-2}$ parts by weight per one part by weight of the organic silver salt.

9. A heat developable photosensitive member according to claim 6 in which the insulating medium is contained in an amount of 0.02–20 parts by weight per one part by weight of the organic silver salt.

10. A heat developable photosensitive member according to claim 6 in which the insulating medium is contained in an amount of 0.1–5 parts by weight per one part by weight of the organic silver salt.

11. A heat developable photosensitive member according to claim 6 in which the total thickness of both layers is 1–50 microns.

12. A heat developable photosensitive member according to claim 6 in which the total thickness of both layers is 2–30 microns.

13. A heat developable photosensitive member adapted to form metallic silver grains at exposed portions which comprises a layer containing a halide and a reducing agent and a layer containing an organic silver salt, an insulating medium and as a compound to enhance formation of metallic silver grains at exposed portions and suppress formation of metallic silver grains at non-exposed portions, at least one member of sulfur compounds having the following formula (1):

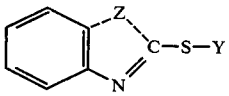

(1)

in which Y is selected from the class of hydrogen, alkyl having 1–6 carbon atoms, unsubstituted or substituted phenyl, benzyl

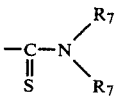

wherein $R_7$ is benzyl, Z is one or more atoms necessary for forming a 5- or 6-membered heterocyclic ring which may be substituted or unsubstituted, the former layer overlying the latter layer.

14. A heat developable photosensitive member according to claim 13 in which the sulfur compound is contained in an amount of $10^{-4}$–$10^{-1}$ part by weight per one part by weight of the organic silver salt.

15. A heat developable photosensitive member according to claim 13 in which the sulfur compound is contained in an amount of $5\times10^{-4}$–$10^{-2}$ parts by weight per one part by weight of the organic silver salt.

16. A heat developable photosensitive member according to claim 13 in which the insulating medium is contained in an amount of 0.02–20 parts by weight per one part by weight of the organic silver salt.

17. A heat developable photosensitive member according to claim 13 in which the insulating medium is contained in an amount of 0.1–5 parts by weight per one part by weight of the organic silver salt.

18. A heat developable photosensitive member according to claim 13 in which the total thickness of both layers is 1–50 microns.

19. A heat developable photosensitive member according to claim 13 in which the total thickness of both layers is 2–30 microns.

20. A heat developable photosensitive member adapted to form metallic silver grains at exposed portions which comprises a layer containing an organic silver salt, a halide and an insulating medium and a layer containing a reducing agent and as a compound to enhance formation of metallic silver grains at exposed portions and suppress formation of metallic silver grains at non-exposed portions, at least one member of sulfur compounds having the following formula (1):

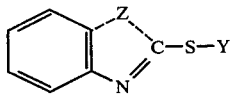

(1)

in which Y is selected from the class of hydrogen, alkyl having 1–6 carbon atoms, unsubstituted or substituted phenyl, benzyl and

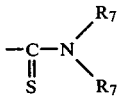

wherein $R_7$ is benzyl, Z is one or more atoms necessary for forming a 5- or 6-membered heterocyclic ring which may be substituted or unsubstituted, the latter laying overlying the former layer.

21. A heat developable photosensitive member according to claim 20 in which the sulfur compound is contained in an amount of $10^{-4}$–$10^{-1}$ part by weight per one part by weight of the organic silver salt.

22. A heat developable photosensitive member according to claim 20 in which the sulfur compound is contained in an amount of $5\times10^{-4}$–$10^{-2}$ part by weight per one part by weight of the organic silver salt.

23. A heat developable photosensitive member according to claim 20 in which the insulating medium is contained in an amount of 0.02–20 parts by weight per one part by weight of the organic silver salt.

24. A heat developable photosensitive member according to claim 20 in which the insulating medium is contained in an amount of 0.1–5 parts by weight per one part by weight of the organic silver salt.

25. A heat developable photosensitive member according to claim 20 in which the total thickness of both layers is 1–50 microns.

26. A heat developable photosensitive member according to claim 20 in which the total thickness of both layers is 2–30 microns.

27. Method for forming silver images comprising (a) imagewise exposing the heat developable photosensitive member of claim 6 and;

(b) thereafter, heat developing said exposed member to form a silver image of high contrast and stability.

* * * * *